US006400358B1

(12) United States Patent
Carter

(10) Patent No.: US 6,400,358 B1
(45) Date of Patent: Jun. 4, 2002

(54) PORTABLE ELECTRONIC PARKING LOCATION REMINDER DEVICE

(76) Inventor: Wendell P. Carter, 735 Dulles, No. 514, Stafford, TX (US) 77477

( * ) Notice: Subject to any disclaimer, the term of this patent is extended or adjusted under 35 U.S.C. 154(b) by 0 days.

(21) Appl. No.: 09/302,536

(22) Filed: Apr. 30, 1999

(51) Int. Cl.[7] ..... G09G 5/00

(52) U.S. Cl. ..... 345/169; 340/457

(58) Field of Search ..... 345/169; 340/457, 340/457.4, 309.15, 693.5, 321

(56) References Cited

U.S. PATENT DOCUMENTS

| | | | | | |
|---|---|---|---|---|---|
| 4,258,491 | A | * | 3/1981 | Ernst et al. | 40/525 |
| 4,354,260 | A | * | 10/1982 | Planzo | 368/10 |
| 4,751,668 | A | * | 6/1988 | Aihara | 364/900 |
| 4,881,758 | A | * | 11/1989 | Ben-David | 283/102 |
| 5,161,118 | A | * | 11/1992 | Matsuda et al. | 364/744 |
| 6,114,953 | A | * | 9/2000 | Martin | 340/457 |

* cited by examiner

*Primary Examiner*—Vijay Shankar
*Assistant Examiner*—Vanel Frenel
(74) *Attorney, Agent, or Firm*—Kenneth A. Roddy

(57) ABSTRACT

A portable electronic parking location reminder device that may be easily carried on a key chain or key ring has an electronic display screen and contains a battery powered microcontroller with memory and timer features. User input keys on the housing allow the user to enter letters and/or numbers corresponding to the location of a parked vehicle, store the entered data, and later retrieve and display the data when it is desired to find the parked vehicle. The user input keys include a mode key for selecting between an alpha mode for entering letters of the alphabet (A–Z), a numeric mode for entering numerals (0–9), and a direction mode for entering letters representing geographical directions (N, NE, E, SE, S, SW, W,). Data is entered and displayed in several distinct fields that correspond to an aspect of the location of the parked vehicle. The identity of a parking lot in which the vehicle is parked may be entered in a first field, the identity of a row of a parking area entered in a second field, the identity of a floor level of a parking facility in a third field, and the identity of a geographical location of a parking area in a fourth field. Stored data may be selectively locked to prevent accidental changing. An automatic reduced power mode reduces power consumption when not in use, and a low battery condition is also displayed.

9 Claims, 2 Drawing Sheets

PORTABLE ELECTRONIC PARKING LOCATION REMINDER DEVICE

BACKGROUND OF THE INVENTION

1. Field of the Invention

This invention relates generally to electronic data recording and indicating devices, and more particularly to a portable electronic parking location reminder device that will record and display the location of a parked vehicle.

2. Brief Description of the Prior Art

Frequently, when parking a vehicle in a parking space in a large parking area, such as at a large shopping mall, airport, sports stadium, or entertainment center, the vehicle occupant(s) will forget the location where the vehicle was parked. Finding the lost vehicle causes a great loss of time, great anxiety, and exposes the person(s) searching for the vehicle to risk of being robbed or mugged and other safety hazards.

Most large parking areas, such those mentioned above provide signs or markers bearing alpha or numeric indicia to identify the parking space or identify various subdivisions of the larger parking area to assist the vehicle occupant(s) in identifying the location or general area in which the vehicle is parked. However, the vehicle occupant(s) must rely upon their memory or write the indicia down, should they happen to have pen and paper handy, so that the vehicle can be located sometime later.

There are several patents that disclose various electronic data recording and indicating devices, none of which are capable of quickly inputting and retrieving data relative to a vehicle parking location, and patents that disclose mechanical parking location aids.

Planzo, U.S. Pat. No. 4,354,260 discloses a personal data bank system in combination with a digital watch. The personal data bank system is capable of generating, storing and recalling alpha-numeric data using a minimum number of switches. The system includes a set control logic circuit capable of generating a sequence of alphanumeric characters which are displayed on the watch. Upon repeated actuations of a single switch, a desired array of characters are selected and thereafter are stored in a memory. Recalling the information is accomplished by either an alphabetic search or by a unique code number system wherein a code number is assigned to each data set. The sequence of characters is generated by the set control logic circuit which includes a blank character to facilitate the programming of the memory.

Aihara, U.S. Pat. No. 4,751,668 discloses a portable electronic memorandum device has a memory for storing character data items. When a switch is operated, all the address areas of the memory are designated so as to sequentially read out all the character data items stored therein. All the character data items are then sequentially displayed on a display. After all the character data items stored in all the address areas are sequentially displayed on the display, the address of the memory is updated by the operation of switches, thus performing an edit operation of the character data items.

Tonegawa et al, U.S. Pat. No. 5,297,119 discloses a data storage device wherein data input through a key switch is displayed on a liquid crystal display and is stored in an EEPROM. The data stored in the EEPROM is immediately read out to check whether the read data coincide with the input data. If the data stored in the EEPROM and read out therefrom does not coincide with the input data, the input data is stored again. If the input data cannot be stored in the EEPROM after storage operation is performed a predetermined number of times, a CPU determines, on the basis of a signal from a battery voltage detecting circuit, whether a voltage applied from a power supply circuit to the EEPROM exceeds a predetermined voltage. On the basis of this determination result, the CPU causes the liquid crystal display to display a cause for the disabled storage operation with respect to the EEPROM.

Piguet, U.S. Pat. No. 4,385,291 discloses an electronic diary watch that permits the selection of a symbol amongst a set of N symbols, e.g. for memorizing a message. A data input device permitting selection of a particular symbol from amongst a set of N symbols includes a display subdivided into K distinct display zones and K selecting elements, each K selecting element being associated with a specific one of the K distinct display zones. The device may be used, for example, in an electronic diary watch to select alphanumeric symbols and thereby record a message for use in the diary mode of operation. A microprocessor connected to the display and selecting elements first causes the set of N symbols to be divided and displayed equally among the K distinct display zones upon manual actuation of a data selection switch. Subsequently, manual actuation of one of the K selecting elements causes the microprocessor to select the symbols of the distinct display zone associated with the actuated selecting element; these selected symbols are equally distributed and displayed among the K distinct display zones. This selecting process is repeated until the desired symbol is isolated and displayed in one of the K distinct zones, at which point manual actuation of the selecting element corresponding to that particular display zone causes the microprocessor to select and memorize that desired symbol. This selecting process is then repeated for each symbol of the message to be memorized.

Matsuba et al, U.S. Pat. No. 5,161,118 discloses hand held data processing apparatus having a central processing unit (CPU) arranged to include a calculating mode for performing calculations and a memorandum pad mode for storing data and for reading the stored data in response to the operation of a reading key. The CPU can be changed to the memory pad mode by the operation of a reading key, so that the reading of the data of the memorandum is started with an easy operation.

Ernst et al, U.S. Pat. No. 4,258,491 discloses a mechanical location indicating device that can be carried on a key ring or chain and is adjustable to display various indicia corresponding to a location, such as that of a parked vehicle. The location indicating device is formed of a flat housing having opposite display and operating ends and an adjustable indicator assembly disposed in the housing including indicating strips carrying indicia for positioning at the display end, the indicating strips being movable via rotatable thumb wheels extending externally of the housing at the operating end to permit selective rotation thereof for positioning selected indicia at the display end of the housing.

Ben-David, U.S. Pat. No. 4,881,758 discloses a vehicle location aid in the form of a disposable printed card for use with a parking lot divided into areas. The disposable card contains unique designations for each parking lot area. The vehicle's driver records the area in which a vehicle is parked by marking, punching out, or removing a removable coating off the portion of the card containing the appropriate designation. Also, the vehicle location aid may contain the date and time of the vehicle's arrival and departure, advertising information, or other desired information.

The present invention is distinguished over the prior art in general, and these patents in particular by a portable electronic parking location reminder device that may be easily carried on a key chain or key ring and has an electronic display screen and contains a battery powered microcontroller with memory and timer features. User input keys on the housing allow the user to enter letters and/or numbers corresponding to the location of a parked vehicle, store the entered data, and later retrieve and display the data when it is desired to find the parked vehicle. The user input keys include a mode key for selecting between an alpha mode for entering letters of the alphabet (A–Z), a numeric mode for entering numerals (0–9), and a direction mode for entering letters representing geographical directions (N, NE, E, SE, S, SW, W,). Data is entered and displayed in several distinct fields that correspond to an aspect of the location of the parked vehicle. The identity of a parking lot in which the vehicle is parked may be entered in a first field, the identity of a row of a parking area entered in a second field, the identity of a floor level of a parking facility in a third field, and the identity of a geographical location of a parking area in a fourth field. Stored data may be selectively locked to prevent accidental changing. An automatic reduced power mode reduces power consumption when not in use, and a low battery condition is also displayed.

SUMMARY OF THE INVENTION

It is therefore an object of the present invention to provide a portable electronic parking location reminder device that will easily and quickly record and display the location of a parked vehicle.

It is another object of this invention to provide a portable electronic parking location reminder device capable of storing alpha and numeric indicia relative to the lot number, the row, the level, and geographical direction of a parked vehicle.

Another object of this invention is to provide a portable electronic parking location reminder device which is small in size and can be conveniently attached to a key ring or key chain, and carried in the pocket or purse of a user for easy access and reference when it is desired to find a parked vehicle.

Another object of this invention is to provide a portable electronic parking location reminder device having a minimum number of data input buttons for entering and displaying alpha and numeric indicia corresponding to the location of a parked vehicle.

Another object of this invention is to provide a portable electronic parking location reminder device having an easily viewable relatively large display that displays alpha and numeric indicia corresponding to the location of a parked vehicle.

A further object of this invention is to provide a portable electronic parking location reminder device having no moving indicating strips, thumb wheels, or other moving parts that can become displaced or changed accidentally to display erroneous data after the correct data has been entered.

A still further object of this invention is to provide a portable electronic parking location reminder device that is inexpensive to manufacture, attractive in appearance and rugged and reliable in operation.

Other objects of the invention will become apparent from time to time throughout the specification and claims as hereinafter related.

The above noted objects and other objects of the invention are accomplished by a portable electronic parking location reminder device that may be easily carried on a key chain or key ring and has an electronic display screen and contains a battery powered microcontroller with memory and timer features. User input keys on the housing allow the user to enter letters and/or numbers corresponding to the location of a parked vehicle, store the entered data, and later retrieve and display the data when it is desired to find the parked vehicle. The user input keys include a mode key for selecting between an alpha mode for entering letters of the alphabet (A–Z), a numeric mode for entering numerals (0–9), and a direction mode for entering letters representing geographical directions (N, NE, E, SE, S, SW, W,). Data is entered and displayed in several distinct fields that correspond to an aspect of the location of the parked vehicle. The identity of a parking lot in which the vehicle is parked may be entered in a first field, the identity of a row of a parking area entered in a second field, the identity of a floor level of a parking facility in a third field, and the identity of a geographical location of a parking area in a fourth field. Stored data may be selectively locked to prevent accidental changing. An automatic reduced power mode reduces power consumption when not in use, and a low battery condition is also displayed.

DESCRIPTION OF THE PREFERRED EMBODIMENTS

Figure 2:
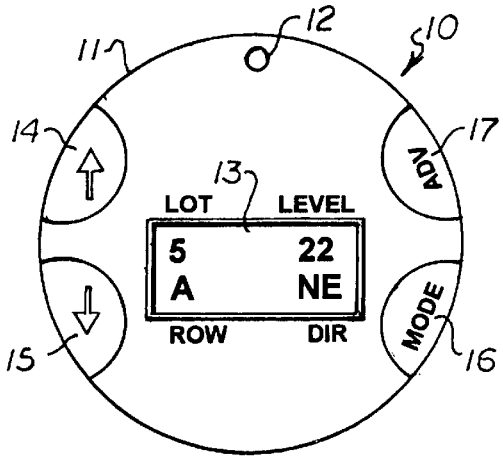
FIG. 2 is a front view of the four-button embodiment of the portable electronic parking location reminder device.
Figure 3:
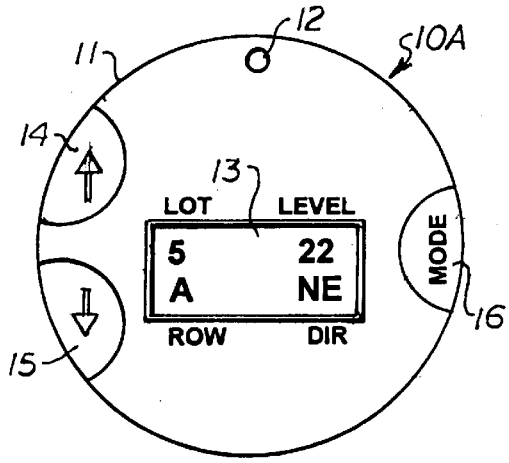
FIG. 3 is a front view of the portable electronic parking location reminder device in accordance with a preferred three-button embodiment of the present invention.
Figure 1:
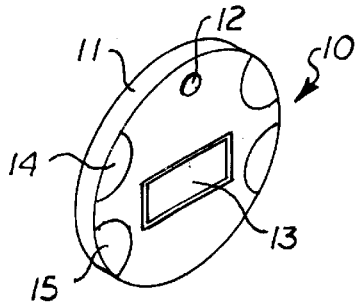
FIG. 1 is a perspective view of the portable electronic parking location reminder device in accordance with a preferred four-button embodiment of the present invention.

Referring to the drawings by numerals of reference, there is shown in FIGS. 1 and 2, a preferred four-button embodiment of the portable electronic parking location reminder device 10, and in FIG. 3, a preferred three-button embodiment of the portable electronic parking location reminder device 10A.

Both embodiments of the device 10 and 10A, have an outer housing 11 formed of a suitable material, such as plastic or metal by conventional molding, casting or stamping techniques. For example, the housing may be made in two half shells that are snap fitted or joined together by other conventional fastening means after the electronic components have been installed. Preferably, the outer housing is assembled so that it may be manually taken apart to replace the battery when it becomes low, or provided with a removable battery compartment cover.

In the preferred embodiments the outer housing 11 is a thin, small circular disc-shaped configuration having an aperture 12 extending through the housing to receive a key chain or key ring (not shown) so that the device and can be conveniently attached to a key ring or key chain, and carried in the pocket or purse of a user for easy access and reference when it is desired to find a parked vehicle.

The outer housing 11 of both embodiments of the device 10 and 10A has a rectangular liquid crystal display screen (LCD) 13 mounted in an opening formed in the front surface of the outer housing. The front surface of the outer housing 11 is also provided with four labels adjacent to the four corners of the display screen 13, labeled "LOT", "ROW", "LEVEL" and "DIR" (direction). The LCD display 13 is a commercially available or custom made LCD display capable of displaying 8 or more characters on two lines, such as an Optrex model DMC-50448N (DGK: 73-1106-ND). Each corner of the display 13 has a field in which the selected characters will appear, with each field capable of displaying three or more characters.

As seen in FIG. 2, the four-button embodiment of the device 10 has an "UP" arrow key or push button 14, a "DOWN" arrow key or push button 15, a "MODE" key or push button 16, and an "ADV" (advance) key or push button 17 mounted in openings on its front face spaced near the outer periphery of the outer housing 11.

The four keys or push buttons 14–17 are commercially available manual push button electronic contact switch mechanisms which complete a circuit when depressed and are biased to return to a normally off position when released. In the following discussion, the contact switches or keys will be described as "buttons". Mode selection and programming are accomplished by pressing the keys or buttons in various combinations, as described hereinafter.

As seen in FIG. 3, the three-button embodiment of the device 10A has an "UP" arrow push button 14, a "DOWN" arrow push button 15, and a "MODE" push button 16 mounted in openings spaced near the outer periphery of the outer housing 11. The three-button button embodiment 10A does not have an "ADV" (advance) button. The advance function in the three-button embodiment is carried out by using the other buttons, as explained hereinafter.

Figure 4:
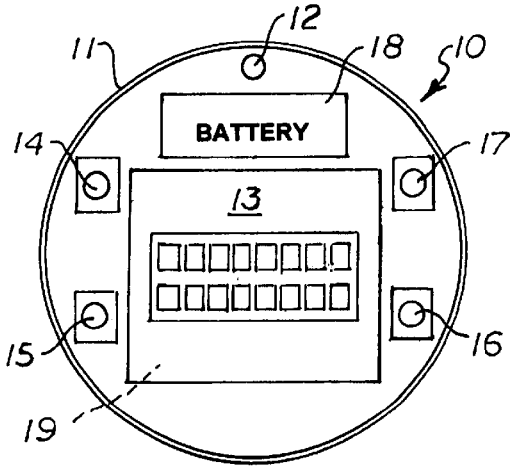
FIG. 4 is a view of the interior of the four-button embodiment of the device showing the components somewhat schematically.
Figure 5:
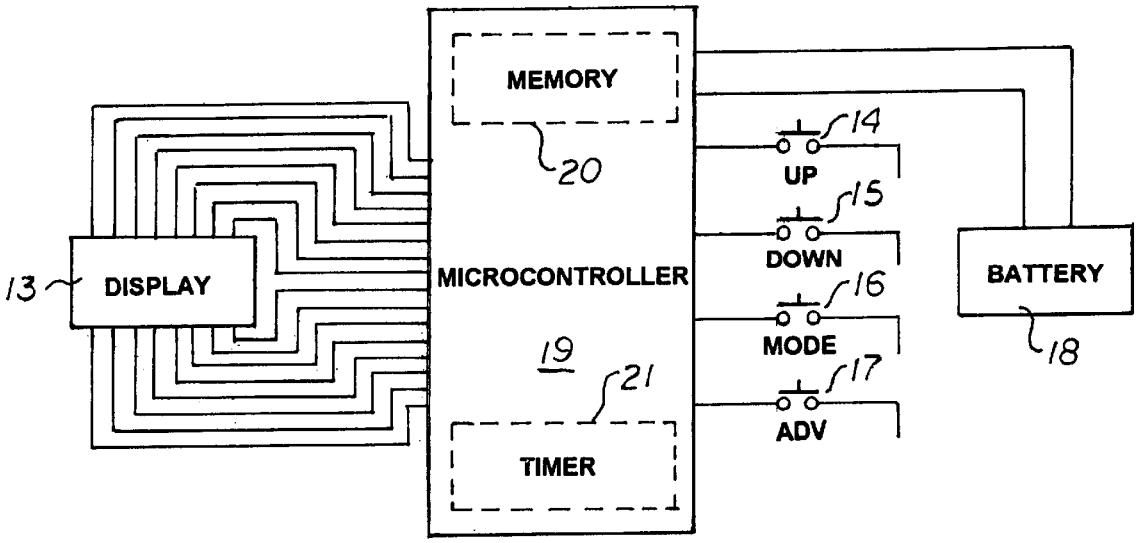
FIG. 5 is a schematic block diagram of the components of the four-button embodiment of the device.

FIG. 4 shows, somewhat schematically, the electronic components that are mounted in the interior of the four-button embodiment of the device 10. FIG. 5 is a schematic block diagram of the electrical components of the four-button embodiment of the device.

It should be understood that in the following discussion, the electronic components and the electrical schematic block diagram of the three-button embodiment 10A would be the same as that shown in FIGS. 4 and 5, but without the "ADV" (advance) push button 17.

Referring now to FIGS. 4 and 5, a DC battery 18 is connected with an IC microcontroller chip 19 coupled with a memory 20. The microcontroller 19 is connected with the LCD display 13, the "UP" arrow push button 14, "DOWN" arrow push button 15, "MODE" push button 16, and "ADV" (advance) push button 17. In a preferred embodiment, all components in the electrical circuit are powered by DC current. The components may be mounted on a printed circuit board or may be mounted individually in the interior of the outer housing 11.

As described hereinafter, the microcontroller chip 19 is programmed with embedded software to read and interpret the push button signals generated by the push buttons 14–17 and carryout functions responsive thereto and to control the display 13. Data corresponding to the parked vehicle location is stored in the memory 20. The microcontroller 19 is also provided with a timer 21. The microntroller 19 may be of the type having integral nonvolatile memory and timer features. Commercially available micontrollers suitable for use in the device are a PIC16C57-RC/SO manufactured by Microchip Technology, Inc., or an Intel model 8051.

Operation of the Four-Button Embodiment

The device is turned "ON" by pressing the "UP" arrow button 14 and the "DOWN" arrow button 15 at the same time. This resets the microcontroller 19, turns on the display 13, and displays the settings that were previously stored in memory 20.

Pressing the "ADV" (advance) button 17 will move a cursor to the next position with in a field on the display 13. If the cursor is at the end of a field the cursor will advance to the first character of the next field. That is to say that the cursor is positioned on the LCD display 13 in a position in the field adjacent to the labels "LOT", "ROW", "LEVEL", or "DIR" (direction) at one of the four corners of the display.

Figure 6:
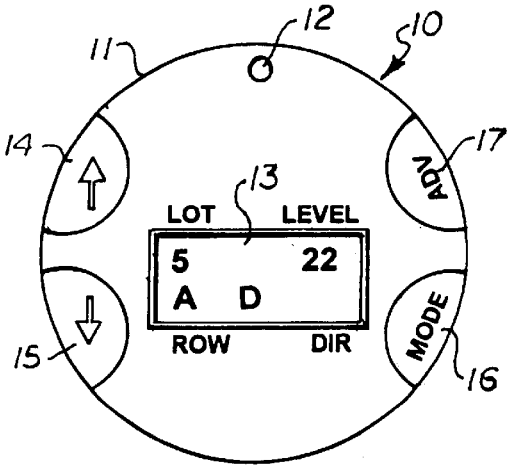
FIG. 6 a front view of the device indicating that the device is in a "direction" mode for data to be entered in the direction field of the display.

Pressing the "MODE" push button 16 switches between an "alpha" mode, a "numerical" mode, and a "direction" mode for the current cursor position. The selected mode is displayed on the display 13 between the "ROW" and "DIR" fields as an "A" (alpha mode), as an "N" (numerical mode), or as a "D" (direction mode), as shown in FIG. 6. The mode character will disappear after about ten seconds. When the "MODE" button 16 is pressed again the mode character will reappear, and to change the mode, it must pressed again.

In the "alpha" mode, the "UP" arrow button 14 and the "DOWN" arrow button 15 are used to select between letters of the alphabet (A through Z) which will appear on the display 13 in the selected field. Pressing the "UP" arrow button 14 will display the letters in an ascending sequence and pressing the "DOWN" arrow button 15 will display the letters in a descending sequence each time the respective button is pressed.

In the "numerical" mode, the "UP" arrow button 14 and the "DOWN" arrow button 15 are used to select between numerals (0–9) which will appear on the display 13 in the selected field. Pressing the "UP" arrow button 14 will display the numerals in an ascending sequence and pressing the "DOWN" arrow button 15 will display the numerals in a descending sequence each time the respective button is pressed.

In the "direction" mode, the "UP" arrow button 14 and the "DOWN" arrow button 15 are used to select between letters representing geographical directions (N, NE, E, SE, S, SW, W, and NW) which will sequentially appear on the display 13 in the field adjacent to the "DIR" label each time the respective button is pressed.

If the lot, row, or level of the parked vehicle is identified by a color rather than a letter of numeral, the user may set the device to the "alpha" mode, and input one or more letters identifying the color in the appropriate "LOT", "ROW", or "LEVEL" field. For example, "R" for red, "Y", for yellow, "G" for green, "BU" for blue, or "BK" for black to identify the corresponding color.

Figure 7:
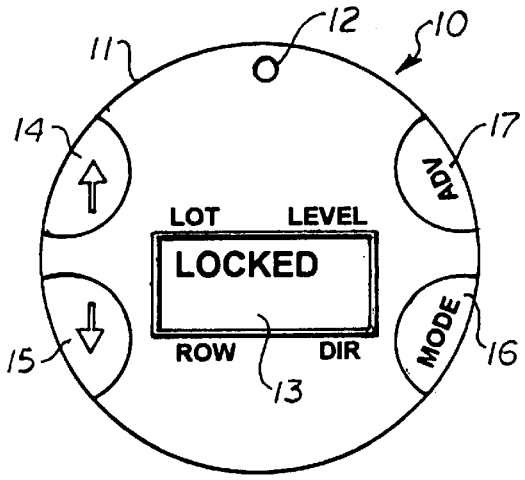
FIG. 7 a front view of the device indicating that the inputted data has been locked into memory.

Pressing the "MODE" button 16 and the "ADV" (advance) button 17 at the same time will store the displayed current user input data into the memory 20, and place the device in a "locked" mode, and the word "LOCKED" will appear on the display 13 (FIG. 7) for about five seconds.

The microcontroller 19 is programmed to automatically enter a power reduction mode or "sleep" mode after a set period of time of being "on" without receiving any user input, for example after two minutes have elapsed. In the "sleep" mode, the microcontroller 19 and the display 13 will enter into a low-power state to preserve the life of the power source.

When the user wants to retrieve the location data, the device is again turned "ON" by pressing the "UP" arrow button 14 and the "DOWN" arrow button 15 at the same time. This restarts the microcontroller, turns on the display 13 and displays the settings that were previously stored in memory 20. The microcontroller 19 may also be programmed to wake up from the "sleep" mode and display the current settings by pressing any two buttons at the same time.

Figure 8:
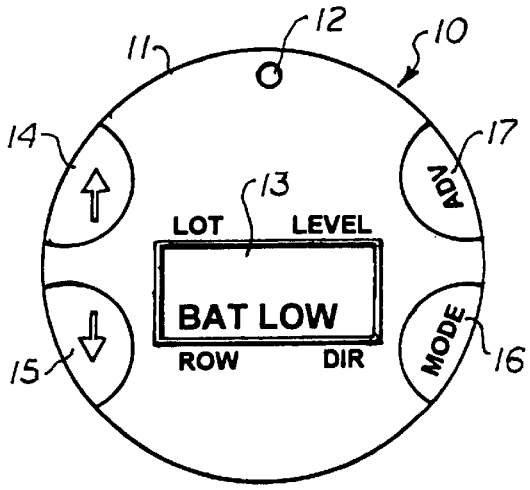
FIG. 8 is a front view of the device indicating a low battery condition.

The microcontroller 19 may also be programmed to sense the amount of current being supplied and to display the words "BAT LOW" (FIG. 8) when the battery power drops below a predetermined level.

The embedded microcontroller software carries out the functions of resetting the system, initialization of the microcontroller, LCD display, ports, interrupts, and variables. The timer 21 will track time elapsed until 2 minutes has been recorded, at which time it will set the sleep signal to initiate the sleep mode. The software also operates in an infinite loop to scan the push button switches for user input and perform associated tasks. (i.e. modify variables and display data on LCD, or saving information into internal memory. Pressing any of the push button switches causes the time elapsed variable to reset to 0.

Operation of the Three-Button Embodiment

The operation of the three-button embodiment 10A is similar to the operation of the four-button embodiment described above, except that it only utilizes three buttons to accomplish the same result. The three-button embodiment 10 will also automatically power down (enter the "sleep" mode) after about two minutes and is turned on by pressing the "UP" and "DOWN" arrow buttons 14 and 15 (or any two buttons) at the same time, and will display the last location data stored in memory 20. It is also programmed to sense the amount of current being supplied and to display the words "BAT LOW" (FIG. 8) when the battery power drops below a predetermined level.

With the three-button embodiment, pressing the "MODE" push button 16 switches between an "alpha" mode, a "numerical" mode, and a "move" mode for the current cursor position. The selected mode is displayed on the display 13 between the "ROW" and "DIR" fields as an "A" (alpha mode), as an "N" (numerical mode), or as an "M" (move mode). The mode character will disappear after 10 seconds. When the "MODE" button 16 is pressed again the mode character will reappear, and to change the mode, it must pressed again.

In the "move" mode, the "UP" arrow button 14 and the "DOWN" arrow button 15 are used to move or advance the cursor to the next position with in a field on the display 13. If the cursor is at the end of a field the cursor will advance to the first character of the next field. That is to say that the cursor is positioned on the LCD display 13 in a position in the field adjacent to the labels "LOT", "ROW", "LEVEL", or "DIR" (direction) at one of the four corners of the display.

In the "alpha" mode, the "UP" arrow button 14 and the "DOWN" arrow button 15 are used to select between letters of the alphabet (A through Z) which will appear on the display 13 in the selected field. Pressing the "UP" arrow button 14 will display the letters in an ascending sequence and pressing the "DOWN" arrow button 15 will display the letters in a descending sequence each time the respective button is pressed.

In the "numerical" mode, the "UP" arrow button 14 and the "DOWN" arrow button 15 are used to select between numerals (0–9) which will appear on the display 13 in the selected field. Pressing the "UP" arrow button 14 will display the numerals in an ascending sequence and pressing the "DOWN" arrow button 15 will display the numerals in a descending sequence each time the respective button is pressed.

To enter the data for the geographical direction with the three-button embodiment the cursor is placed in the field adjacent to the "DIR" label, the "MODE" push button 16 is pressed to switch to the "alpha" mode, and then the arrow buttons 14 and 15 are used to select the individual letters representing geographical directions (N, NE, E, SE, S, SW, W, and NW).

With the three-button embodiment, pressing the "MODE" button 16 and holding it down for about two seconds will store the current user input data which has been displayed into the memory 20, and place the device in a "locked" mode, and the word "LOCKED" will appear on the display 13 (FIG. 7) for about five seconds. When the "MODE" button 16 is again pressed and held down for about two seconds, the stored data will become unlocked and can be changed.

If the lot, row, or level of the parked vehicle is identified by a color rather than a letter of numeral, the user may set device to the "alpha" mode, and input one or more letters identifying the color in the appropriate "LOT", "ROW", or "LEVEL" field, as described previously.

While this invention has been described fully and completely with special emphasis upon preferred embodiments, it should be understood that within the scope of the appended claims the invention may be practiced otherwise than as specifically described herein.

For example, the LCD display 13 may be provided with a backlight, or may be replaced with an LED, gas plasma or other display to perform the equivalent display functions.

What is claimed is:

1. A portable electronic parking location reminder device for ring displaying the location of a parked vehicle, comprising:

a portable housing;

user input keys on said housing including keys for entering data representing the identity of a parking lot, a parking level, a parking row, and a geographical direction of said location of said parked vehicle, and for storing and retrieving said entered data;

non-volatile memory within said housing for storing said entered data;

an electronic LCD display on said housing having a visually distinct parking lot field, a parking level field, a parking row field, and a geographical direction field for displaying said entered data and said retrieved data as a set of letters or numerals in said visually distinct fields;

a microcontroller within said housing coupled with said memory, said user input keys, and said display, said microcontroller containing an embedded software program responsive to said user input keys for displaying said entered data as letters and numerals, storing said entered data in said memory, retrieving said stored data, and displaying said stored data on said display as letters and numerals;

a battery power supply in said housing for powering said microcontroller, said memory, and said display;

at least one said user input key that sequentially displays letters and numerals to be selected by the user in an ascending or descending order and alphabetic geographical direction characters when it is pressed;

said letters and numerals representing the identity of the parking lot in which the vehicle is parked, the floor level of a parking facility on which the vehicle is parked, the row of a parking area in which the vehicle is parked, and said alphabetic geographical direction characters representing the geographical direction of the parking area in which the vehicle is parked; and at least one said user input key that enters selected letters, numerals, and alphabetic geographical direction characters in a desired position within respective ones of said fields.

2. The portable electronic parking location reminder device according to claim 1, wherein said user input keys include a mode key for selecting between an alpha mode for entering letters of the alphabet and a numeric mode for entering numerals; and at least one key which, in the respective alpha or numeric mode, will display a letter or a numeral in an ascending or descending order each time it is pressed.

3. The portable electronic parking location reminder device according to claim 1, wherein said user input keys include a mode key for selecting between an alpha mode for entering letters of the alphabet, a numeric mode for entering numerals, and a direction mode for entering letters representing geographical directions;

at least one key which, in the respective alpha or numeric mode, will display a letter or a numeral in an ascending or descending order each time it is pressed; and at least one key which, in the direction mode, will display letters corresponding to geographical directions each time it is pressed.

4. The portable electronic parking location reminder device according to claim 1, wherein said user input keys include a pair of keys, which when pressed at the same time will turn said device on, supply power to said microcontroller and said display, and display said data that was previously stored in said memory.

5. The portable electronic parking location reminder device according to claim 1, wherein said user input keys include a first pair of keys which, when pressed at the same time, will store said entered data in said memory in a locked condition to prevent it from being changed; and a second pair of keys which, when pressed at the same time, will unlock said entered data in said memory to allow it to be changed; and said microcontroller is programmed to display indicia on said display representing the locked condition.

6. The portable electronic parking location reminder device according to claim 1, further comprising:

timing means coupled with said microcontroller and said power supply.

7. The portable electronic parking location reminder device according to claim 6, wherein said user input keys include a key which, when pressed and held down for a predetermined time interval a first time, will store said entered data in said memory in a locked condition to prevent it from being changed; and when pressed and held down for a predetermined time interval a second time, will unlock said entered data in said memory to allow it to be changed; and said microcontroller is programmed to display indicia on said display representing the locked condition.

8. The portable electronic parking location reminder device according to claim 6, wherein said microcontroller is programmed to shut off said display and enter a reduced power consumption state after a predetermined amount of time has elapsed without use of said user input keys to conserve power.

9. The portable electronic parking location reminder device according to claim 1, wherein said microcontroller is programmed to sense the condition of said battery power supply and upon sensing that power has dropped below a predetermined level, to display indicia on said display representing the low power condition.

* * * * *